US005625972A

United States Patent [19]

King et al.

[11] Patent Number: 5,625,972

[45] Date of Patent: May 6, 1997

[54] GUN WITH ELECTRICALLY FIRED CARTRIDGE

[76] Inventors: Albert I. King, 1000 Bretton La., Bloomfield Hills, Mich. 48304-2910; Mark P. Libich, 8180 N. Canton Center Rd., Canton, Mich. 48187

[21] Appl. No.: 521,865

[22] Filed: Aug. 31, 1995

[51] Int. Cl.[6] ..... F41A 19/58; F42B 5/08

[52] U.S. Cl. ..... 42/84; 89/135; 89/28.05; 102/472

[58] Field of Search ..... 42/84; 89/135, 89/28.05; 102/472, 206, 200

[56] References Cited

U.S. PATENT DOCUMENTS

| | | | |
|---|---|---|---|
| 2,931,039 | 4/1960 | Henning et al. | 89/28.05 |
| 3,269,315 | 8/1966 | Gauld . | |
| 3,413,888 | 12/1968 | Kaley | 89/28.05 |
| 3,427,924 | 2/1969 | Johnsen . | |
| 3,650,174 | 3/1972 | Nelsen | 42/84 |
| 3,768,413 | 10/1973 | Ramsay . | |
| 3,844,216 | 10/1974 | Jokobs et al. . | |
| 4,130,060 | 12/1978 | Murray . | |
| 4,285,153 | 8/1981 | Crouch . | |
| 4,324,060 | 4/1982 | Lawrence . | |
| 4,771,692 | 9/1988 | Ninio et al. . | |
| 4,881,463 | 11/1989 | Ninio et al. . | |
| 5,115,743 | 5/1992 | Loffler | 102/472 |
| 5,233,902 | 8/1993 | Bernardes . | |
| 5,235,127 | 8/1993 | Findley . | |
| 5,263,416 | 11/1993 | Amundson et al. . | |
| 5,272,828 | 12/1993 | Petrick et al. . | |
| 5,285,727 | 2/1994 | Reams, Jr. et al. . | |
| 5,450,686 | 9/1995 | La Mura et al. | 42/84 |
| 5,469,790 | 11/1995 | Singer | 42/84 |
| 5,515,783 | 5/1996 | Hesse et al. | 102/472 |

*Primary Examiner*—Michael J. Carone
*Assistant Examiner*—Theresa M. Wesson
*Attorney, Agent, or Firm*—Brooks & Kushman P.C.

[57] ABSTRACT

A gun is provided with an electronically fired cartridge. The cartridge includes a primer cap with a heat sensitive primer therein. A fuse wire of appropriate electrical resistance extends through the primer, and a pair of contacts are affixed with a gun to provide a voltage to the fuse wire in order to cause a flow of current through the fuse wire to ignite the primer. An electric circuit is provided on the gun body for supplying electric power to the contacts. The circuit includes a switch, a battery, and first and second contacts which are in electrical communication with the fuse wire when the cartridge is in the gun.

12 Claims, 1 Drawing Sheet

GUN WITH ELECTRICALLY FIRED CARTRIDGE

TECHNICAL FIELD

The present invention relates to firearms, and more particularly to firearms with electronically fired cartridges.

BACKGROUND ART

Recently, a need has developed to "personalize" guns in order to allow only a single user for a gun, to prevent the use of a firearm by an assailant against its owner, and to prevent accidental shootings by children. "Personalization" of guns may also be used to place responsibility for causing injury or death entirely upon the owner of the weapon. In order to accomplish this weapon personalization, it is desirable to provide a firing mechanism which is completely electronic. The electronic firing mechanism would also facilitate the design of a personalized firearm which is tamper-resistant.

Traditionally, percussion type primers are used in gun cartridges in combination with a hammer to ignite gunpowder in order to fire bullets. Currently no electronically fired primer designs exist which are feasible for manufacturing, or for use in combination with a gun personalization system. Accordingly, it is desirable to provide a gun which fires cartridges fully electronically.

It is particularly desirable to provide a design for electrically discharging gun cartridges which would be adaptable for use with existing gun cartridges whiteout significantly altering the existing cartridge design.

SUMMARY OF THE INVENTION

The present invention provides a gun with an electronically fired cartridge. The cartridge includes a primer cap with heat sensitive primer therein. A fuse wire of appropriate electrical resistance extends through the primer. A pair of contacts fixed with the gun provide a voltage to the fuse wire in order to ignite the primer and fire the bullet.

The present invention provides a gun and cartridge assembly comprising a gun body including a barrel. A removable cartridge is received within the barrel. The cartridge includes a chamber with an explosive and a primer cap with a heat sensitive primer therein ignitable for igniting said explosive. A fuse wire of appropriate electrical resistance having first and second ends extends through the primer for igniting the primer. An electric circuit is secured to the gun body for supplying electric current to the fuse wire. The circuit comprises a switch for opening and closing the circuit. The switch is in electrical communication with one of the first and second ends of the fuse wire. A battery includes first and second terminals, and one of the terminals is in electrical communication with the switch. A first contact is in electrical communication with the other of the terminals and further in electrical communication with the other of the first and second ends of the fuse wire. Electric current traveling through the fuse wire will ignite the heat sensitive primer when the switch closes the circuit. An electronic circuit board is provided in electrical communication with the switch for closing the switch when a signal is received from the gun trigger.

Accordingly, an object of the present invention is to provide a gun with an electronically fired cartridge which is feasible for high volume manufacturing.

A further object of the present invention is to provide a gun with an electronically fired cartridge which is reliable and includes a rapidly igniting primer.

Yet another object of the present invention is to provide an apparatus for electrically discharging gun cartridges which is compatible with existing gun cartridge designs.

The above objects and other objects, features and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
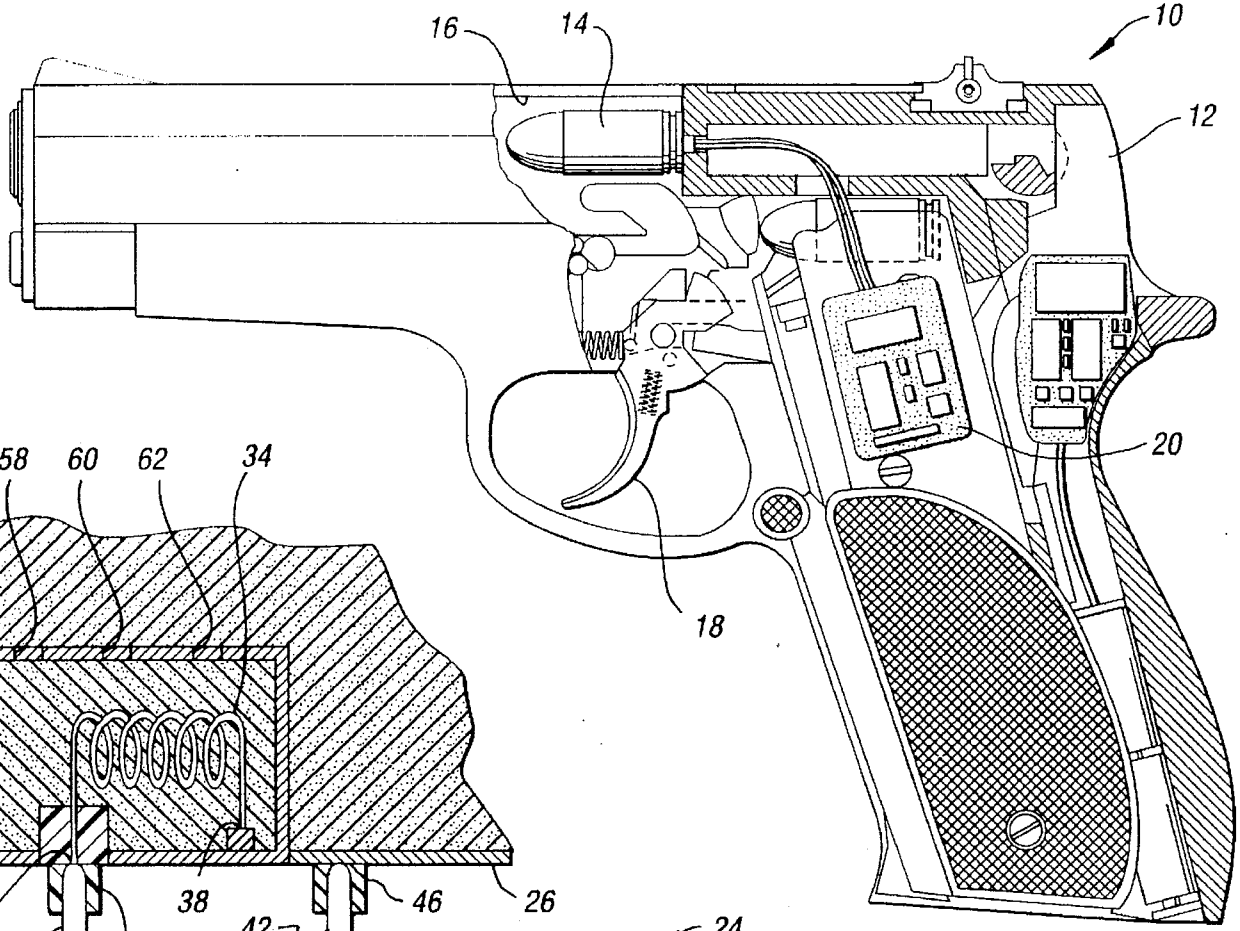
FIG. 1 shows a schematically arranged, partially cutaway side view of a gun with an electronically fired cartridge in accordance with the present invention.
Figure 2:
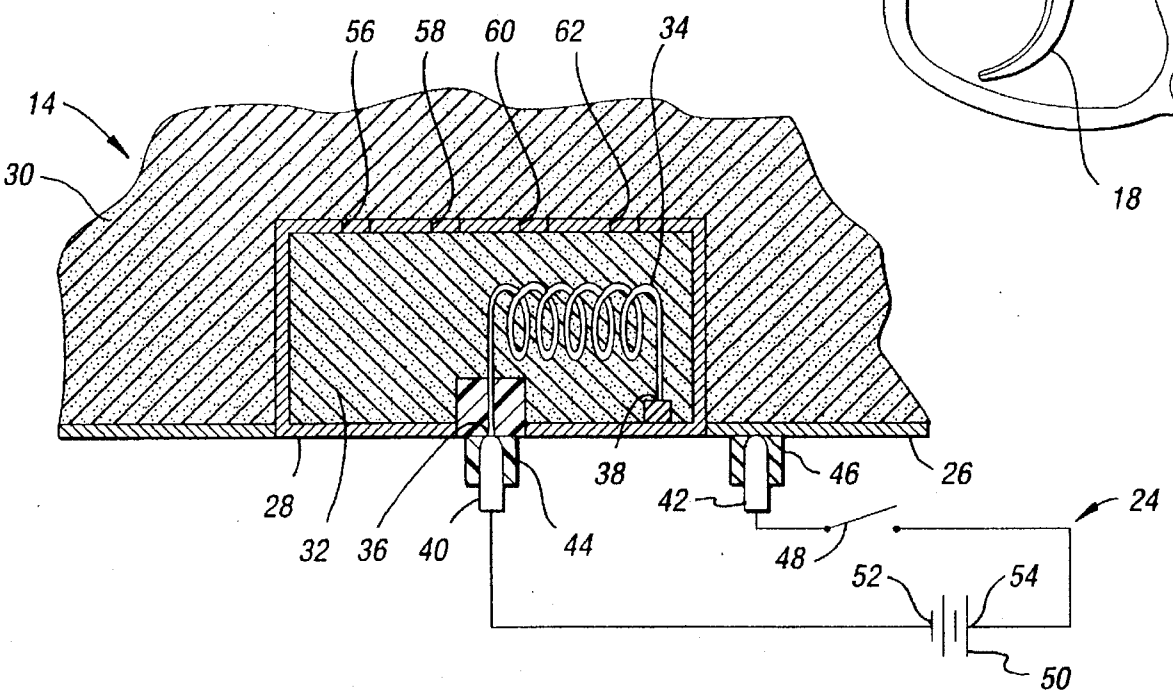
FIG. 2 shows a schematically arranged enlarged sectional view of an electronic circuit and primer cap for an electronically fired gun cartridge in accordance with the present invention.

FIGS. 1 and 2 show an electronically discharged gun and cartridge assembly 10 in accordance with the present invention. The gun and cartridge assembly 10 includes a gun body 12 and a gun cartridge 14. The cartridge 14 is received within a barrel 16 formed in the gun body 12. A trigger 18 is pivotally mounted to the gun body 12 for actuating ignition of the gun cartridge 14.

An electronic circuit board 20 is provided for controlling discharge of the gun cartridge. The circuit board 20 may be used in combination with a gun personalization system. The electronic circuit board 20 communicates with an electric circuit 24 (shown schematically in FIG. 2) for firing the cartridge.

FIG. 2 shows a schematically arranged enlarged sectional view of an electronic circuit 24 for the electronically fired cartridge 14. The cartridge 14 includes a metal butt 26 and a metal primer cap 28. The cartridge 14 includes gunpowder 30 therein for firing a bullet. The gunpowder 30 is ignited by the heat sensitive primer 32 which is disposed within the primer cap 28.

A fuse wire 34 having first and second ends 36,38 extends through the heat sensitive primer 32 for igniting the primer when a voltage is present between the first and second ends 36, 38.

A voltage is provided to the first and second ends 36,38 of the fuse wire 34 by means of the electric circuit 24. The electric circuit 24 comprises first and second contacts 40, 42, which are in electrical communication with the wire 34. The first contact 40 is positioned adjacent the center of the cartridge butt 26. The first contact 40 is in electrical communication with the first end 36 of the fuse wire 34, and insulation 44 is provided to insulate the contact from the rest of the cartridge 14 so that an electric current can be set up through the fuse wire 34 to heat up the primer rapidly and set it off. The second end 38 of the fuse wire 34 is in electrical communication with the metal primer cap 28, which, in turn, is in electrical communication with the second contact 42. The second contact 42 includes insulation 46, and is in electrical communication with the switch 48. The switch 48 is in electrical communication with the battery 50, which is also in electrical communication with the first contact 40.

Accordingly, when the trigger 18 is pulled, and the electronic circuit board 20 closes the switch 48, the circuit 24 is closed. At this point, a voltage from the terminals 52,54 of the battery 50 is set up between the first and second contacts 40,42. With the cartridge 14 in position, the voltage set up across the first and second contacts 40,42 causes a current to travel through the fuse wire 34. Since the first contact 40 is in electrical communication with the first end 36 of the fuse wire 34, and the second contact 42 is in electrical communication with the metal butt 26, metal primer cap 28, and second end 38 of the fuse wire 34, a circuit is established through which current can flow. The fuse wire 34 then heats up, and ignites the heat sensitive primer 32, which ignites the gunpowder 30 in order to fire a bullet. Apertures 56, 58, 60, 62 are provided in the primer cap 28 to communicate the primer 32 with the gun powder 30 so that the primer 32 may ignite the gun powder 30.

Of course, varying configurations may be used for applying a voltage to the fuse wire. First and second contacts 40, 42 may be placed in different positions on the butt 26 and primer cap 28.

In manufacturing the electrically discharged cartridge, a short insulated wire will be inserted into the center of the cap 28. One end of the fuse wire will be soldered to the insulated wire (the first end of the fuse wire), and the other end of the fuse wire will be soldered to the primer cap 28 (the second end of the fuse wire). The primer compound 32 is then poured or molded around the fuse 34 without damaging the circuitry. Accordingly, in comparison to current manufacturing processes for cartridges, the only major difference for use with the present invention is the manufacture of the primer cap. Because the primer cap will have the same size and location on the cartridge 14, manufacturing and overall design of cartridges will not be adversely effected.

If a non-metallic primer cap is used, the second contact 42 and second end 38 of the fuse 34 must be positioned so that contact will occur between the two for electrical communication to occur.

While the best mode for carrying out the invention has been described in detail, those familiar with the art to which this invention relates will recognize various alternative designs and embodiments for practicing the invention. Thus, the above described preferred embodiment is intended to be illustrative of the invention which may be modified within the scope of the following appended claims.

What is claimed is:

1. A gun and cartridge assembly, comprising:

a gun body, including a barrel;

a removable cartridge received within the barrel, the cartridge including a chamber with an explosive and a primer cap with a heat sensitive primer therein ignitable for igniting said explosive, and an electrically resistant fuse wire having first and second ends and contained within the primer cap for igniting the primer, wherein the primer cap is in contact with the explosive and includes apertures formed therethrough to facilitate ignition of the explosive; and an electric circuit in the gun body for providing electric current to the fuse wire, the circuit comprising:

a switch positionable for opening and closing the circuit, the switch being in electrical communication with one of said first and second ends of the fuse wire;

an electrical power source including first and second terminals, one of said terminals being in electrical communication with the switch; and a first contact in electrical communication with the other of said terminals and further in electrical communication with the other of said first and second ends of the fuse wire;

whereby electric power traveling through the fuse wire will ignite the heat sensitive primer when said switch is positioned in one of said opening and closing positions.

2. The gun and cartridge assembly of claim 1, wherein said primer cap including a metal casing, and said second end of said fuse wire being in electrical communication with said metal casing.

3. The gun and cartridge assembly of claim 2, wherein said cartridge further comprising a metal butt in electrical communication with said metal casing.

4. The gun and cartridge assembly of claim 3, further comprising a second contact in electrical communication between said switch and one of said metal butt and metal casing.

5. The gun and cartridge assembly of claim 4, further comprising an insulating barrier between said first end of said fuse wire and said metal casing.

6. The gun and cartridge assembly of claim 1, further comprising an electronic circuit board in electrical communication with said switch for opening and closing the switch.

7. A gun and cartridge assembly comprising:

a gun body, including a barrel;

a removable cartridge received within the barrel, the cartridge including a chamber with an explosive and a primer cap with a heat sensitive primer therein ignitable for igniting said explosive, and an electrically resistant fuse wire having first and second ends and contained within the primer cap for igniting the primer, wherein the primer cap is in contact with the explosive and includes apertures formed therethrough to facilitate ignition of the explosive; and an electric circuit in the gun body for providing electric current to the fuse wire, the circuit comprising:

a switch for opening and closing the circuit, the switch being in electrical communication with one of said first and second ends of the fuse wire;

a battery including first and second terminals, one of said terminals being in electrical communication with the switch;

a first contact in electrical communication with the other of said terminals and further in electrical communication with the other of said first and second ends of the fuse wire; and an electronic circuit board in electrical communication with said switch for opening and closing the switch;

whereby electric power traveling through the high resistance wire will ignite the heat sensitive primer when said switch is positioned in one of said opening and closing positions.

8. The gun and cartridge assembly of claim 7, wherein said primer cap including a metal casing, and said second end of said fuse wire being in electrical communication with said metal casing.

9. The gun and cartridge assembly of claim 8, wherein said cartridge further comprising a metal butt in electrical communication with said metal casing.

10. The gun and cartridge assembly of claim 9, further comprising a second contact in electrical communication between said switch and one of said metal butt and metal casing.

11. The gun and cartridge assembly of claim 10, further comprising an insulating barrier between said first end of said fuse wire and said metal casing.

12. For use in a gun, an electrically fired gun cartridge, comprising:

a generally cylindrical chamber with an explosive therein;

an electrically conductive primer cap within the chamber, the primer cap having a heat sensitive primer therein ignitable for igniting the explosive; and an electrically resistant fuse wire contained within the primer cap for igniting the primer, the fuse wire having first and second ends for receiving electric power from the gun, said first end being positioned to receive electric power from the gun when the cartridge is in the gun, and said second end being in electrical communication with the primer cap to receive electric power therethrough, wherein the primer cap is in contact with the explosive and includes apertures formed therethrough to facilitate ignition of the explosive;

whereby electric power received from the gun travels through the fuse wire, which gives off heat to ignite the primer.

* * * * *